US005797860A

United States Patent [19]

Moriyasu

[11] Patent Number: 5,797,860

[45] Date of Patent: Aug. 25, 1998

[54] LOW PROFILE VIBRATING FLOOR MAT

[76] Inventor: Hiro Moriyasu, 1314 SW. 57th Ave., Portland, Oreg. 97221

[21] Appl. No.: 686,732

[22] Filed: Jul. 26, 1996

[51] Int. Cl.[6] ..... A61H 1/00

[52] U.S. Cl. ..... 601/30; 601/57; 601/78

[58] Field of Search ..... 601/30, 49, 56, 601/57, 58, 59, 61, 78, 79, 80, 81

[56] References Cited

U.S. PATENT DOCUMENTS 3,075,101 1/1963 Neff ..... 601/78 X

*Primary Examiner*—William H. Grieb

*Attorney, Agent, or Firm*—Dellett and Walters

[57] ABSTRACT

A low profile vibrating floor mat includes a magnetic gap elastomer placed between vibrating magnetic laminates. The elastomer controls the magnetic gap and prevents the magnetic gap from physically collapsing due to the body weight. Upper and lower protective materials insulate the vibrating magnetic laminates from the environment while effectively transfering vibrating energy to the surface of the floor mat. The floor mat is able to withstand body weight.

6 Claims, 6 Drawing Sheets

LOW PROFILE VIBRATING FLOOR MAT

BACKGROUND OF THE INVENTION

This application pertains to floor mats and more particularly to a low profile vibrating floor mat capable of withstanding body weight.

Industrial workers and other people who must remain in a standing position for a sustained period of time often desire relief from the stress of the sustained standing periods.

Heretofore, there have been numerous prior art foot vibrators and massagers. While meeting the requirements for sitting down and home use, they do not meet the requirements for standing and industrial use. The primary limitation of the prior art foot vibrators are that the vibrator is not thin enough.

Conventional vibrators such as motor and eccentric wheels are subject to motor wear and are not thin, and are unsuitable for use in floor mats. The solenoid type or relay type vibrators are bulky and are also unsuitable for use in floor mats.

This invention must be thin enough to replace the conventional floor mat, have a non-trip edge, non-slip, be immune to liquid spills, and endure the heavy wear and tear of industrial usage.

SUMMARY OF THE INVENTION

This invention is a low profile vibrating floor mat, able to withstand body weight. A magnetic gap elastomer placed between vibrating magnetic laminates controls the magnetic gap and prevents the magnetic gap from physically collapsing due to the body weight. Upper and lower protective materials insulate the vibrating magnetic laminates from the environment. This device effectively transfers vibrating energy to the surface of the floor mat.

An objective of this invention is to provide an improved thin vibrating element to be incorporated in a floor mat.

Another objective of this invention is to transfer energy from the vibrating element to the top of the floor mat, while protecting the vibrating device from collapsing from the total weight of the user.

Yet, another objective of this invention is to provide an improved vibrating floor mat that eliminates any critical air gap or spring tension that could cause the vibrator to collapse, or create undesirable chattering noise, or to be unreliable.

A further objective of this invention is to provide improved methods for fastening the top and bottom protective material that allow insertion of the vibrating mechanism.

A yet further objective of this invention is to provide an improved cushion-like floor mat. Air pockets in the molded floor mat material will reduce weight, provide controlled resilience, and support and protect the magnetic vibrating element.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
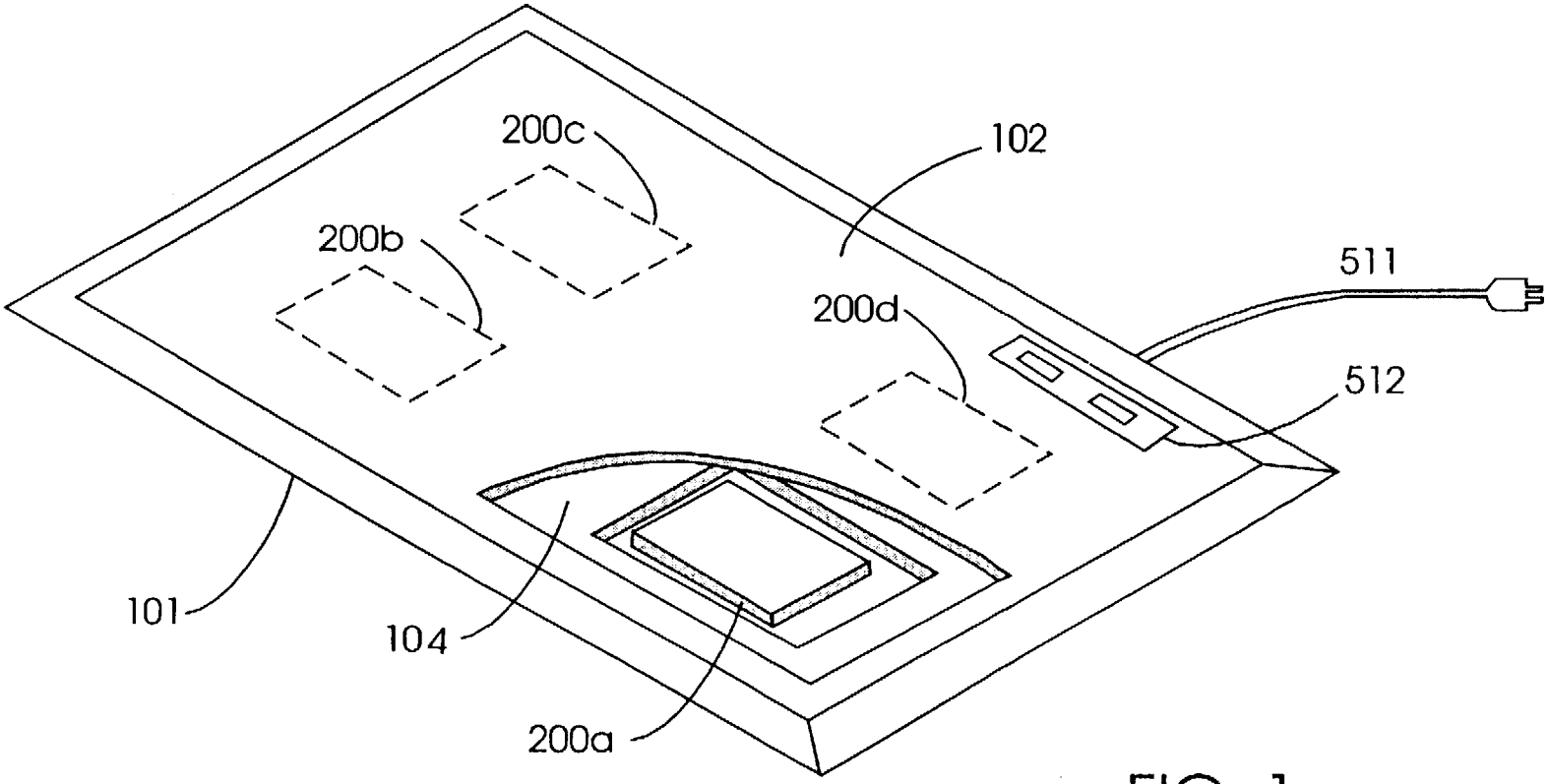
FIG. 1 Pictorial illustration of a vibrating floor mat containing low profile vibrating devices.

FIG. 1 is a pictorial illustration of the vibrating floor mat containing the low profile vibrating devices vibrating assemblies 200*a*, 200*b*, 200*c*, 200*d* are placed on a mat base 101. An inner layer support elastomer 104 provides an internal frame structure and cushion for the vibrator assemblies. Inner layer support elastomer 104 also holds the top layer 102 of the mat, and the mat base 101 together.

In FIG. 1, the lower right hand of the vibrating mat is cut out to show the internal structure of a vibrator assembly 220*a*. FIG. 1 also illustrates the tapered non-trip edge of the mat.

Power cord 511 supplies AC power to the floor mat through control unit 512. Control unit 512 distributes the power to the vibrator assemblies. The electronic control unit contains a power on/off switch, and a hi/low vibrator strength control.

Figure 2:
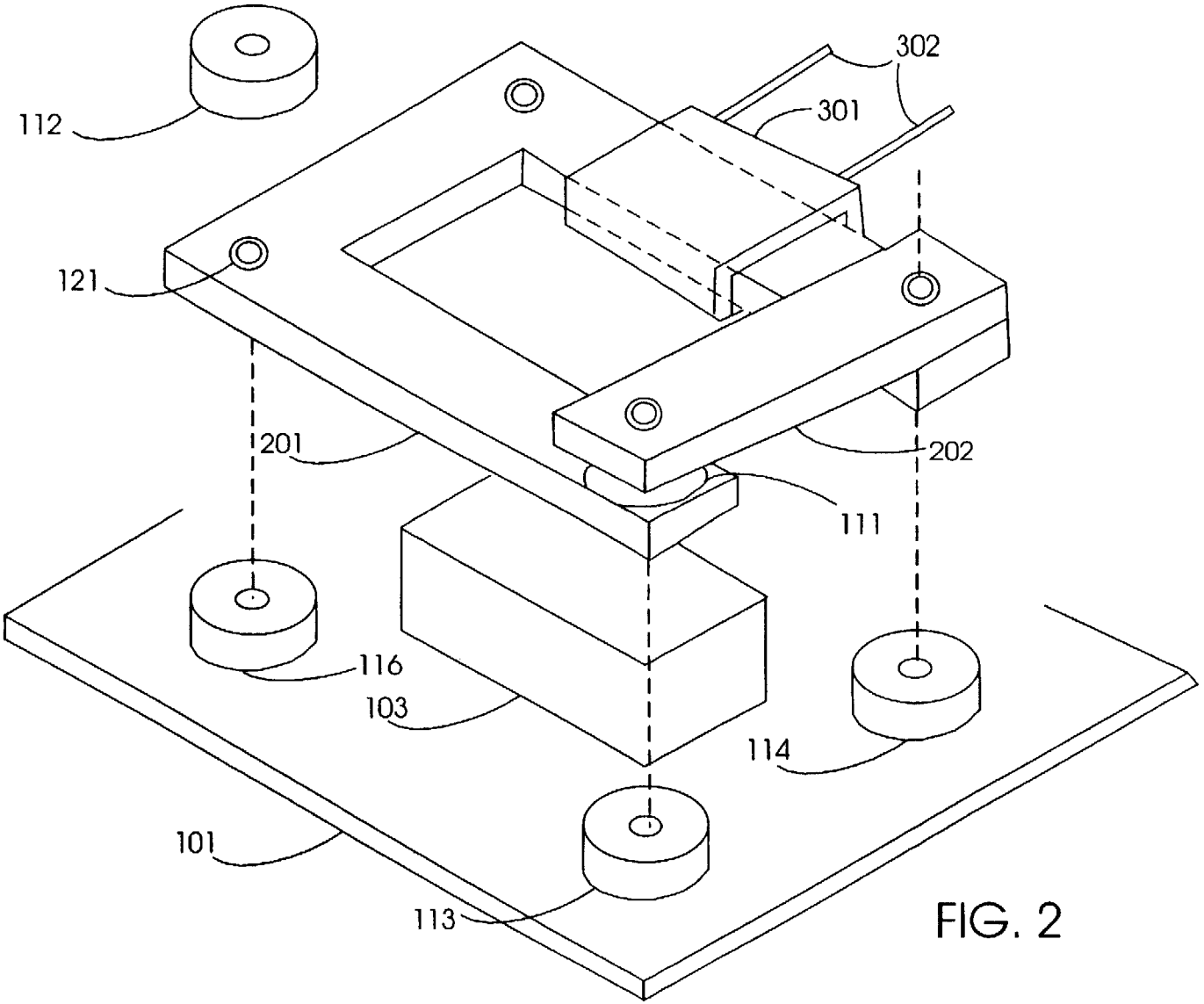
FIG. 2 illustrates internal components of a vibrator assembly.

FIG. 2 illustrates the internal components of the vibrator assembly. The vibrator device consists of a "C" shaped magnetic core laminate 201, and an "I" shaped magnetic laminate 202. The "I" shaped magnetic laminate 202 is fastened to one arm of the "C" core, 201.

Electrical power is applied to magnetic coil wire 302 and the magnetic coil assembly 301 and provides magnetic force to the vibrating device. This magnetic force created by the coil creates attracting magnetic force at the magnetic gap. Magnetic gap elastomer 111 is inserted in the gap between "C" core 201 and "I" core 202 to control the spacing of the magnetic gap. The elastomer also prevents the gap from collapsing when body weight is applied. The vibrating device is mounted on four lower elastomers 113, 114, 115 (not shown), and 116 which are suitably placed on top of base mat 101. These lower elastomers provide floating support to the vibrator device.

Inner support elastomer 103 is placed inside the vibrator device on base mat 101 to provide structural support between the lower base mat and the top layer of mat (not shown). The inner support elastomer also functions as a controlled inner support cushion and protects the vibrating device from collapsing due to body weight applied from the top of the mat.

Figure 3:
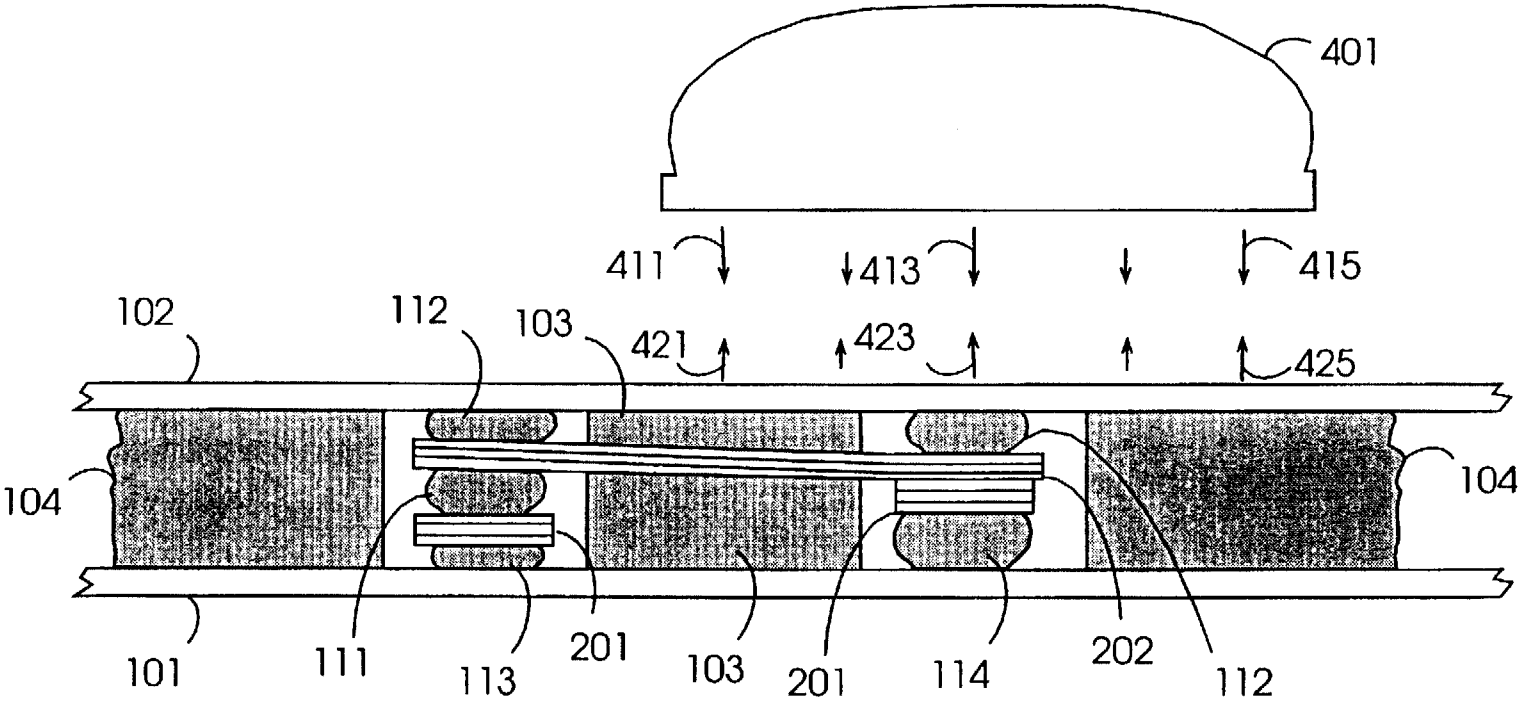
FIG. 3 illustrates cross sectional cutout view of vibrating floor mat.

FIG. 3 illustrates a cross sectional cut out view of a vibrating floor mat in accordance with the invention. The upper right side of FIG. 3 shows a cross section of one of a user's shoes 401. The lower part of the illustration shows a cross sectional view of the vibrating floor mat that consists of base mat 101, top layer 102, and support elastomers 103 and 104. FIG. 3 also shows the edge view of "C" core 201, "I" core 202, magnetic gap elastomer 111, and lower elastomers 113 and 114. Upper elastomers 112 and 112*a* are also shown, and suitably maintain separation between the top of "C" core 201 and the top layer 102.

The low profile floor mat must be rigid enough to protect the magnetic device from the force and body weight of users. However, the floor mat cannot be so solid and stiff as to dampen the transfer of vibrations to the user's feet.

FIG. 3 shows how a body weight load protection and vibrating energy transfer mechanism can be achieved by this invention.

Three types of elastomers are utilized in the floor mat:

Body weight bearing elastomers 103, 104, and 104*a;*

Upper and lower energy coupling elastomers 112, and 112*a*, 113, and 114; and Magnetic gap elastomer 111.

Shoe 401 transfers the user's static body weight and movement downward as forces 411, 413, 415. When shoe 401 contacts the top layer of mat 102, it creates counter opposing forces 421, 423, and 425. These counter opposing forces are transmitted downward to compress various components of the vibrator and elastomers. The exact composition of counter forces depends on the shape of the shoe, the angle of contact, the deflection of the mat and the resilience of elastomers in the mat. It is important to note that by making the body weight bearing elastomers 103, 104, and 104*a* stiffer than upper and lower energy coupling elastomers 112 and 112*a*, 113 and 114, the major static body weight will be supported by the body weight bearing elastomers 103 an 104. This protects the vibrator device from being compressed and constrained.

When magnetic power is applied to "C" core 201, "C" core 201 and "T" core 202 are pulled together, whereby magnetic gap elastomer 111 is compressed. Closing the magnetic gap causes a lever action on "T" core 202, which rotates counter-clockwise. Since "T" core 202 is fastened to the "C" core 201 at the right hand side of the "C" core 201 it will create an upward twist motion at the right hand end of "T" core. This upward motion will transmit differential force through energy coupling elastomers 112 and 112*a* and through the top layer of mat 102. These vibration forces and motion are transmitted upward through the bottom of shoe 401 and to the user's feet in the shoes.

Similar protection of body weight and energy transfer action hold true even if the user takes a step left causing the shoe 401 to now be placed above magnetic gap elastomer 111. In this instance the major static body weight load is still supported by body weight bearing elastomers 103, 104 and 104*a*. Since upper coupling elastomers 112 and 112*a* are softer than body weight bearing elastomers 103, 104 and 104*a*, the vibrating device is protected from physically collapsing.

To further assure magnetic gap elastomer 111 will not collapse from body weight load, the resilience of elastomer 111 must be slightly stiffer than energy coupling elastomers 112, 112*a* and 113.

Figure 4:
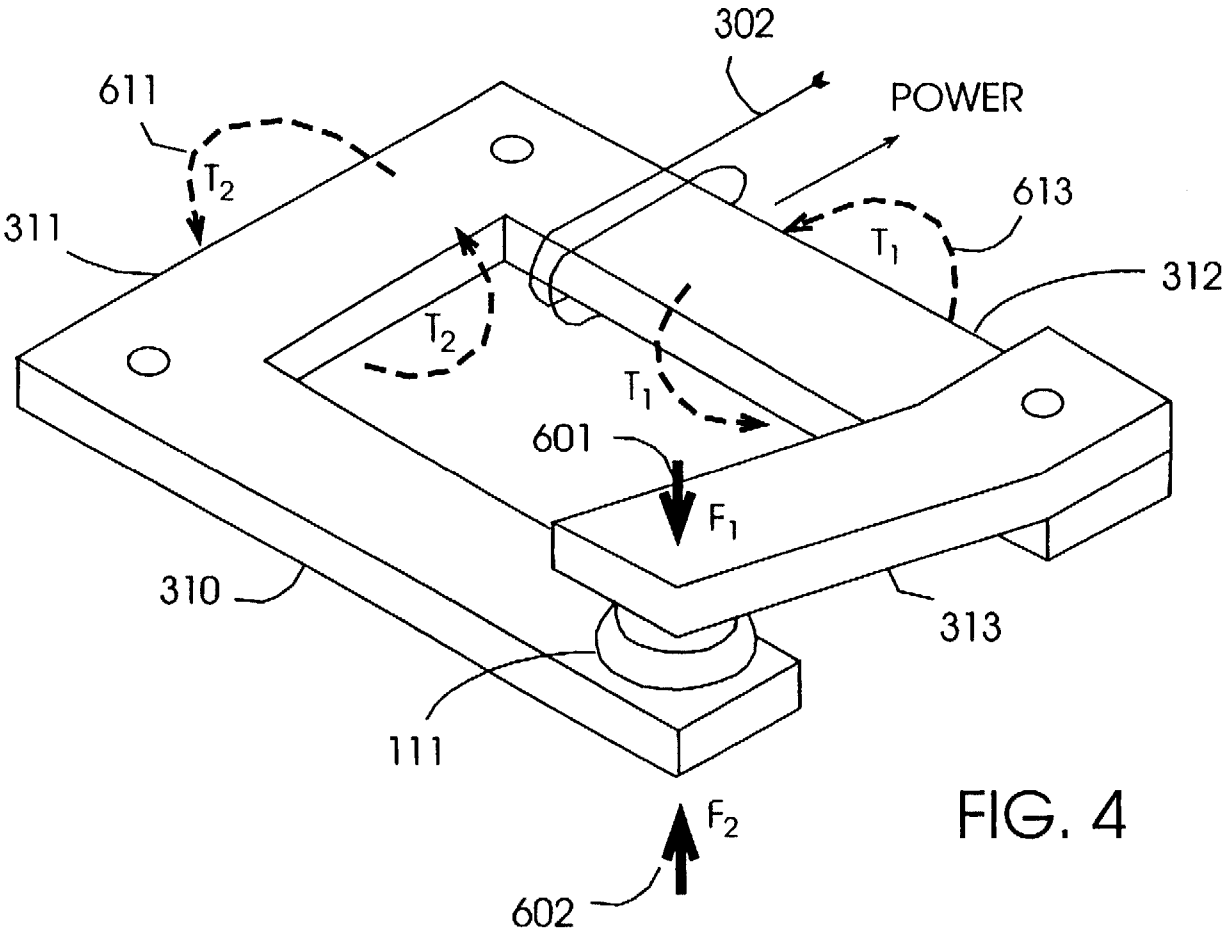
FIG. 4 illustrates the basic vibrating motion of electromagnetic "C" core laminates.

FIG. 4 illustrates how vibrating motion is transmitted to various portions of the core laminates and how the vibrating force is multiplied in some parts of the laminates. Electromagnetic force applied to the magnetic coil 302 causes various bendings and deflections and creates vibrating motions at various parts of the magnetic core laminates.

Magnetic force F2, 602 will deflect the lower laminate member 310 upward at the magnetic gap end, and this deflection is coupled to the left hand member of "C" core 311 and creates a counter-clockwise twisting torque force T2, 611 thus deflecting the left hand member of "C" core 311 counter-clockwise. It is important to note the force magnification effect of this configuration. Deflection of the lower magnetic laminate member, 310 at the gap end by F2 causes a smaller deflection. However, the force is much magnified as laminate member 310 connects with the left hand member of "C" core 311. The force magnification is equivalent to the lever action of a crowbar. The deflection at the long lever end causes a smaller deflection at the opposite end or the pivot end of the lever with force multiplied by the ratio of the long lever end and the pivot end.

Still referring to the FIG. 4, we trace the effect of magnetic force F1, 601 deflecting "T" core laminate 313 downward. The downward motion deflects "T" core laminate 313 and causes a lever action. Force multiplication at the pivoting end of "T" core 313 twists right upper "C" core laminate 312, resulting in a twisting torque of T1, 613. This will result in a twisting rotating deflection counter-clockwise on the upper right "C" core laminate 312.

When power is removed from the magnetic coil 302 and the electromagnetic force eliminated, compression energy stored in the magnetic gap elastomer 111 causes elastomer 311 to expand. Energy stored in the magnetic laminates in the form of deflected or twisted beam energy also causes the elastomer gap end to expand with forces equal to F1, 601 and F2, 602, but in the opposite direction. This action created deflection in the opposite direction of the power engaged mode. When alternating current (AC) power is applied to the magnetic coil 302, vibrating motion occurs not only at the elastomer gap, but in virtually all parts of the magnetic laminate in the form of vertical or twisting vibrating motion.

To achieve high Q or lower loss vibration, an elastomer such as silicon rubber low-loss material with medium density value may be chosen for the magnetic gap elastomer 111.

Placement of the magnetic gap elastomer not only provides energy storage when compressed but allows a controlled magnetic gap. Traditionally an air gap has been used, but often there is difficulty in controlling the air gap and this often causes the physical gap to collapse when external force is applied, creating an undesirable buzzing noise. Conventional air gap design requires a stiffer spring and more gap spacing is needed. Therefore, air gaps are unsuitable for low profile mats. The use of the magnetic gap elastomer in accordance with the proposed invention overcomes several limitations imposed by the prior art.

Figure 5:
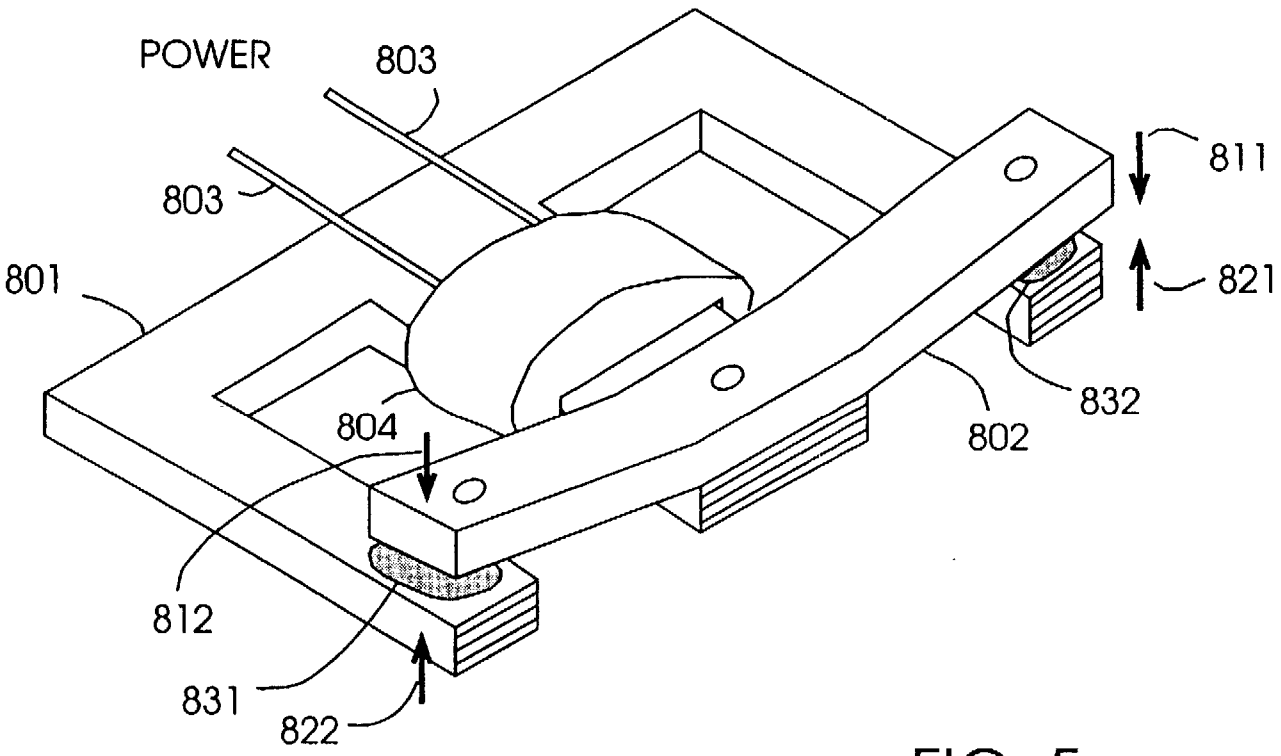
FIG. 5 illustrates the basic vibrating motion of electromagnetic "E" core laminates.

FIG. 5 illustrates the "E" core implementation of low profile vibrator. The "E" core vibrator operates similarly to "C" laminate core version except the vibration is symmetrical to the center of "E" core laminate 801. When power is applied to the magnetic coil 804 through wire 803, a magnetic field is created in the middle arm of the "E" core. One half of magnetic force will flow through the upper arm of the "E" core, through the upper magnetic gap, and through upper part of "T" core laminate 802, then back to the center of the "E" core. Likewise the other half of the magnetic force will flow through the lower arm of the "E" core laminate, through the lower elastomer magnetic gap, through lower part of "T" core laminate 802. These magnetic forces cause contracting forces of 811 and 821 at the upper elastomer magnetic gap 832, and similar contracting forces 812 and 822 at the lower elastomer gap 831.

This compression at the elastomer gap creates a deflection of the "E" core and "T" core laminates and also creates a twisting motion at the upper left and lower left of the "E" shaped core due to the lever action of the upper "E" core arm and lower "E" core arm. AC current in the magnetic coil will cause a compression and expansion motion at all four corners of the "E" core 801, and "T" core 802 vibrator assembly.

A single coil is used for illustration purposes, however, it is well appreciated by those skilled in the industry that more than one coil may be placed in the various arms of magnetic core laminates to achieve various form factors or additional effects.

For example, if two separate coils (not shown) are placed in the "E" core, one coil on the upper arm of the "E" core and the second coil on the lower arm of "E" core, the vibrator can operate in several modes of vibration depending on the polarity of electric power at each of the coils. The opposite phase of electromagnetic power in a coil will sum the magnetic force at the center and essentially operate in the same manner as a single coil shown in the FIG. 5. In-phase magnetic power at the upper and lower coils will create a larger magnetic loop of upper arm, left hand arm, bottom arm of "E" core and "T" core laminate. The middle arm of the "E" core will not create a magnetic path in this mode, thus this is equivalent to the "C" core-like operation.

If electric power to the coils is applied alternately rather than simultaneously, then a sea-saw action of "T" core laminates can be achieved. This two coil version on an "E" core drive creates a push-pull or differential drive effect. Locking motion of the "T" beam is achieved by magnetic pull motion of independent upper and lower coils. This means the vibration in each direction is of balanced strength.

Figure 6:
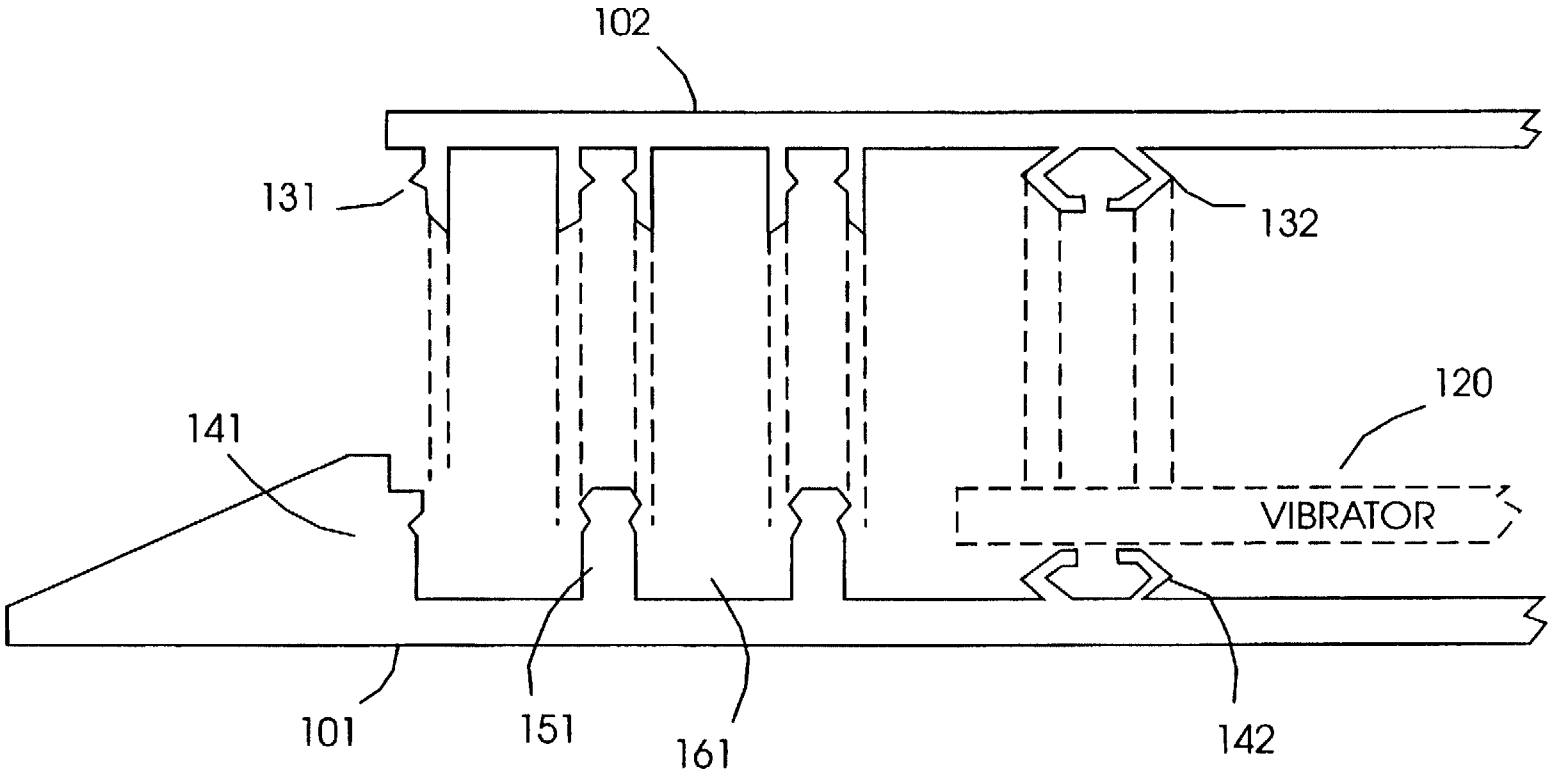
FIG. 6 illustrates a cross section of the floor mat upper layer and lower layer assembly.

FIG. 6 illustrates the assembly of the vibrating floor mat that protects the vibrator assembly, and provides floating support. The floor mat may be molded with rubber materials to achieve flexibility, resist floor wear and tear, and provide immunity from liquid spills and electrical isolation.

This cutout side view shows an example of implementation based on a top and lower base layer that sandwich the vibrator assembly. The base plate 101 incorporates a tapered corner edge 141 for safety. Controlled cushion webs 151 connect the upper layer mat 102 to the lower mat base 101. The lower floating elastomer cushion lower energy coupling elastomers 142 support the vibrator assembly. The top layer 102 mat has an anti-slip surface upper surface. The snap in protrusions 131 at bottom side of the top layer mat to interlock top and lower layer mat and hold the vibrator assembly with controlled elastomer support upper energy coupling elastomer 132.

The upper and lower surfaces of the mat are supported by column 151, which may be formed in the square grid pattern or diagonal pattern with a large air gap 161. Proper proportion of height and width of supporting columns to the width of the column wall and spacing of the air gap will reduce weight and provide necessary cushion to the portion of the mat where there is no magnetic vibrator below.

These column webs provide comfort cushions but also provide sufficient supporting strength to protect the vibrating mechanism from compression. Additional interconnecting supports similar to supporting web 151 may be placed inside open space "C" core or "E" core as a stand off. This will further protect the vibrating assembly from being compressed by the body weight of the user standing on top of the mat above the vibrating assembly.

The upper floating elastomer coupler 132 and lower floating elastomer support coupler 142 are semi balloon or angle shaped for softer cushioning.

This softer cushioning is advantageous to protect the vibrating unit magnetic gap elastomer from collapsing when the user steps above the vibrator assembly. These softer floating elastomers upper and lower energy coupling elastomers 132 and 142 provide vibrating energy to the top layer mat and user's shoes and to the feet of the user standing on the mat. Although FIG. 6 illustrates examples of assembly, there are various methods of fastening a variety of materials to achieve similar results. Such variations are covered within scope of this invention.

While preferred embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

What is claimed is:

1. A low profile vibrator floor mat, comprising:

upper and lower protective covering material;

first magnetic laminates substantially in the shape of "C" or "E" cores, and second substantially "T" shape magnetic laminates placed on top of the first laminates with one end physically fastened to the first laminates, and the other end free to be magnetically vibrated.

2. A low profile vibrator floor mat according to claim 1 further comprising an elastomer placed in a gap between ones of the first laminates and the corresponding second laminates.

3. A low profile electrically operated vibrator mat comprising:

a top covering material;

a bottom covering material;

plural first magnetic laminates wherein ones of said laminates are substantially in the shape of an "E" core; and substantially "T" shape second magnetic laminates positioned adjacent ones of said first magnetic laminates, wherein a portion of ones of said second laminates is fastened to a portion of ones of said first laminate, and wherein another portion of ones of said second laminates are relatively free to be magnetically vibrated.

4. A low profile electrically operated vibrator mat according to claim 5 further comprising an elastomer placed in the gap between the first substantially "E" shaped laminates and the second substantially "T" shaped laminates.

5. A low profile electrically operated vibrating floor mat comprising:

a vibrator element, upper and lower protective floor mat material, and elastomeric material substantially filling at least a portion of the space between the vibrator element and upper and lower floor mat materials, further comprising additional elastomeric material sandwiched between the upper and lower protective floor mat material in areas other than adjacent the vibrator element, wherein said additional elastomeric material has stiffer elastomeric properties than the elastomeric material adjacent the vibrator element.

6. A low profile electrically operated vibrating floor mat comprising:

a vibrator element, upper and lower protective floor mat material, and elastomeric material to fill the space between the vibrator and upper and lower floor mat materials, wherein the vibrator element is positioned between the upper and lower protective floor mat material, and wherein the supporting elastomer material sandwiched between the upper and lower floor mat material has stiffer elastomeric properties than the space filling magnetic vibration energy transfer elastomer.

* * * * *